US009376632B2

(12) United States Patent
Fraczak et al.

(10) Patent No.: US 9,376,632 B2
(45) Date of Patent: Jun. 28, 2016

(54) APPARATUS FOR CONDUCTING THERMOLYSIS OF PLASTIC WASTE AND METHOD OF THERMOLYSIS IN CONTINUOUS MANNER

(71) Applicant: CLARITER IP S.A., Grand-Duché Du (LU)

(72) Inventors: Daria Fraczak, Jaworzno (PL); Bartlomiej Karbowy, Warsaw (PL); Bartlomiej Samardakiewicz, Pruszków (PL)

(73) Assignee: CLARITER IP S.A., Luxembourg (LU)

( * ) Notice: Subject to any disclaimer, the term of this patent is extended or adjusted under 35 U.S.C. 154(b) by 339 days.

(21) Appl. No.: 14/187,439

(22) Filed: Feb. 24, 2014

(65) Prior Publication Data

US 2014/0171701 A1 Jun. 19, 2014

Related U.S. Application Data

(62) Division of application No. 13/256,254, filed as application No. PCT/IB2009/052830 on Jun. 30, 2009, now Pat. No. 8,680,349.

(30) Foreign Application Priority Data

Mar. 14, 2009 (PL) ..... 387499

(51) Int. Cl.
*C07C 1/00* (2006.01)
*C10G 1/10* (2006.01)
(Continued)

(52) U.S. Cl.
CPC . *C10G 1/10* (2013.01); *C10B 47/18* (2013.01); *C10B 49/14* (2013.01); *C10B 53/00* (2013.01); *C10B 53/07* (2013.01); *C10G 2300/1003* (2013.01)

(58) Field of Classification Search
CPC ..... C10G 1/10; C10B 47/18; C10B 49/14; C10B 53/00; C10B 53/07
USPC ..... 585/241; 202/96; 201/25
See application file for complete search history.

(56) References Cited

U.S. PATENT DOCUMENTS 4,225,392 A 9/1980 Taylor
4,851,601 A 7/1989 Fukuda et al.
(Continued)

FOREIGN PATENT DOCUMENTS

EP 0662503 A1 7/1995
EP 0675189 A1 10/1995
(Continued)

OTHER PUBLICATIONS

Written Opinion for PCT/IB09/052830, Sep. 14, 2011.
(Continued)

*Primary Examiner* — Nina Bhat
(74) *Attorney, Agent, or Firm* — Paul D. Bianco; Katherine Davis; Fleit Gibbons Gutman Bongini & Bianco PL

(57) ABSTRACT

An apparatus and method for thermolysis of waste plastic in which reaction residue and carbonization products are continuously removed is described. The apparatus includes a feeding system, an extruder, a reactor for thermolysis, a dual agitator housed within the reactor, a trigger system in operative connection with the reactor, a flux heater, and a collecting system in operative connection with the reactor. The reactor for thermolysis has a height at least 1.5 times bigger than a diameter. The trigger system includes a circulation pump and the collecting system has a three-way valve in an external circulation loop. The apparatus is arranged such that the extruder follows the feeding system, the reactor follows the extruder, the trigger system is at a bottom of the reactor, and the flux heater and collecting system follow the reactor.

2 Claims, 1 Drawing Sheet

(51) Int. Cl.

| | |
|---|---|
| *C10B 53/07* | (2006.01) |
| *C10B 53/00* | (2006.01) |
| *C10B 49/14* | (2006.01) |
| *C10B 47/18* | (2006.01) |

(56) References Cited

U.S. PATENT DOCUMENTS

| | | | | |
|---|---|---|---|---|
| 4,919,686 | A | 4/1990 | Edwards | |
| 4,944,867 | A | 7/1990 | Mundstock et al. | |
| 5,292,862 | A | 3/1994 | Miura et al. | |
| 5,608,136 | A * | 3/1997 | Maezawa | C10B 53/07 201/2.5 |
| 5,731,483 | A | 3/1998 | Stabel et al. | |
| 5,738,025 | A | 4/1998 | Tachibana | |
| 5,753,086 | A | 5/1998 | Guffey et al. | |
| 6,066,263 | A | 5/2000 | Makino et al. | |
| 6,172,275 | B1 * | 1/2001 | Tadauchi | C10G 1/00 423/481 |
| 6,534,689 | B1 | 3/2003 | Stankevitch | |
| 6,861,568 | B1 | 3/2005 | Guffey et al. | |
| 7,714,178 | B2 * | 5/2010 | Bylicki | C10G 1/10 201/25 |
| 8,674,154 | B2 * | 3/2014 | Podeszfa | C10B 47/18 201/25 |
| 8,680,349 | B2 * | 3/2014 | Fraczak | C10G 1/10 110/346 |
| 9,074,140 | B2 * | 7/2015 | Fraczak | C10B 49/14 |
| 2005/0075521 | A1 | 4/2005 | Wada | |
| 2008/0200738 | A1 | 8/2008 | Grispin | |
| 2010/0282587 | A1 | 11/2010 | Brentnall et al. | |
| 2011/0259726 | A1 | 10/2011 | Podeszfa et al. | |

FOREIGN PATENT DOCUMENTS

| | | | |
|---|---|---|---|
| EP | 0763412 | A1 | 3/1997 |
| EP | 1707614 | A1 | 10/2006 |
| PL | 205461 | | 12/2004 |
| PL | 208922 | B1 | 7/2007 |
| PL | 196880 | B1 | 2/2008 |
| PL | 380619 | A1 | 3/2008 |
| PL | 211917 | B1 | 10/2008 |
| PL | 211493 | B1 | 5/2012 |
| WO | 9503375 | A1 | 2/1995 |
| WO | 2005065006 | A2 | 7/2005 |
| WO | 2010/106399 | | 6/2009 |

OTHER PUBLICATIONS

International Preliminary Report on Patentability for PCT/IB09/052830 dated Sep. 20, 2011.

Foust et al, Principles of Unit Operations, 1980, p. 569-571.

XP002603024, "Principles of Unit Operations, Passage", Foust A S et al, Apr. 26, 2011.

International Search Report, published Nov. 5, 2010 for PCT/IB2009/052830.

Walendziewski, Jerzy et al., "Thermal and catalytic conversion of waste polyolefines",Catalysis Today, 2001, 323-330, Elsevier Science B.V., Wroclaw, Poland.

Walendziewski, Jerzy, "Continous flow cracking of waste plastics", Fuel Processing Technology, 2005, 1265-1278, Elsevier B.V., Wroclaw, Poland.

* cited by examiner

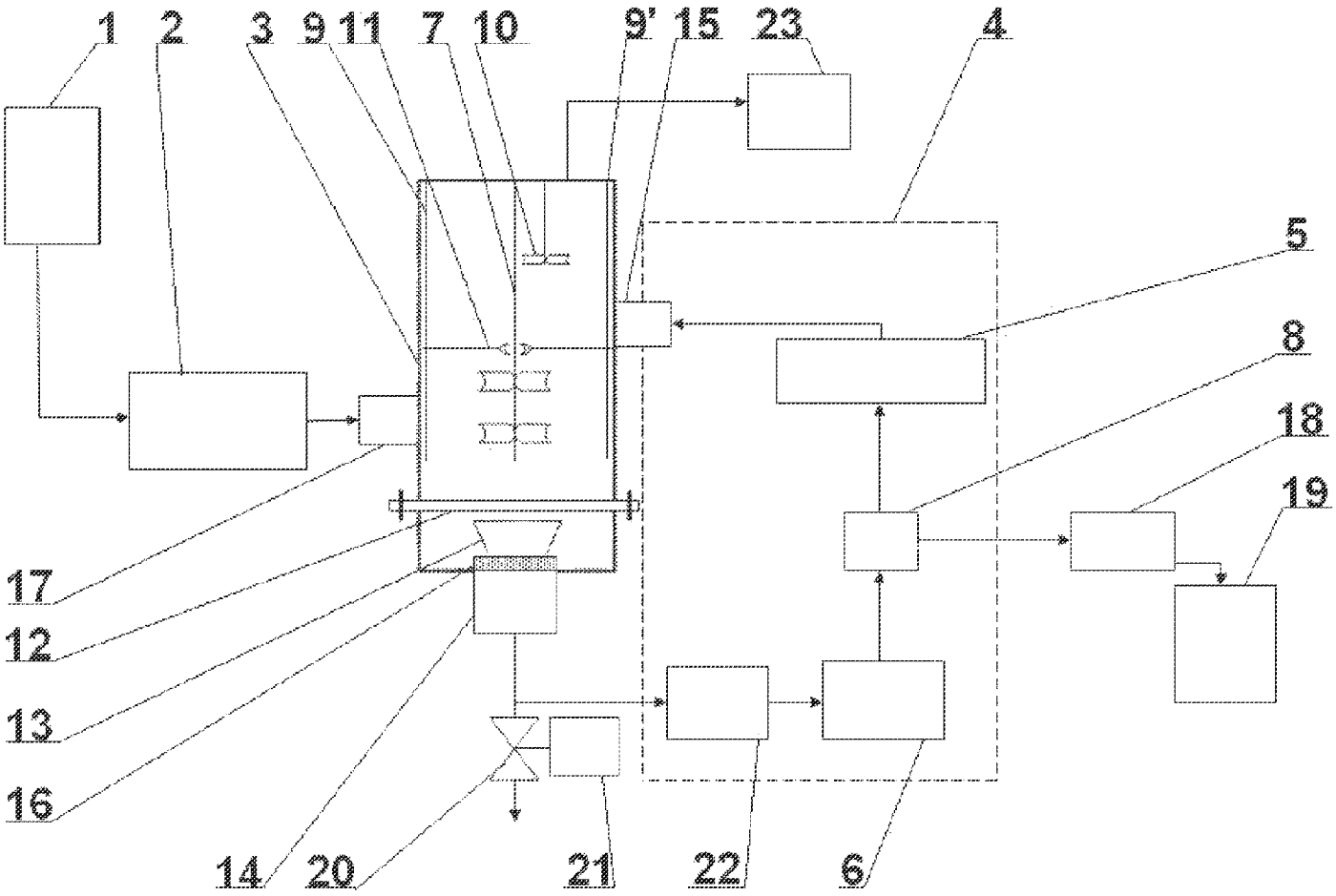
1
2
3
9
11
7
10
9'
15
23
4
5
8
18
19
6
22
21
20
14
16
13
12
17

APPARATUS FOR CONDUCTING THERMOLYSIS OF PLASTIC WASTE AND METHOD OF THERMOLYSIS IN CONTINUOUS MANNER

CROSS REFERENCE TO RELATED APPLICATIONS

This application is a divisional application of U.S. patent application Ser. No. 13/256,254, filed Sep. 13, 2011, which was a U.S. National Stage Application of International Patent Application No. PCT/IB09/52830, filed Jun. 30, 2009, which claimed priority to Polish Patent Application No. P 387499, filed Mar. 14, 2009. The entire content of each of these applications is incorporated in entirety herein by reference.

FIELD OF THE INVENTION

This invention provides an apparatus for conducting thermolysis of plastic waste and a method of thermolysis with continuous waste plastics feeding and continuous removing of carbonization products and reaction leftovers.

BACKGROUND OF THE INVENTION

U.S. Pat. No. 4,851,601—applied for protection on 19 Jan. 1988, description defines a method of getting hydrocarbon oils from waste plastics which is based on thermal cracking in liquid phase and through catalytic conversion of vapors of cracking products with catalyst presence.

From Japanese Patent, applied for protection on 19 Aug. 1996, published as EP 0763412, there is known a waste plastics pyrolysis reactor which involves a reactor with a waste plastics inlet located at one end and a liquefied plastic outlet and hydrogen chloride outlet located at the next end, and a waste heater situated between the plastic inlet and hydrogen chloride outlet. The reactor has a screw funnel heater for conducting plastics in the reactor from charge to outlet.

From U.S. Pat. No. 6,066,263, applied for protection on 12 Mar. 1998, there is known a system for hydrothermal reaction conversion of waste plastics into oil. Plant has a tank for keeping a mixture of water and plastics, a high-pressure pump connected through a flow channel, and a shift valve with tank. The shift valve is connected with a water passing channel. The reactor has bowed pipes connected with an injection pump. The bowed pipes are equipped with heating agents and are connected through a pressure reduction valve with effluent tank. The velocity of flow of the reaction mixture passed to the reactor may be controlled by the pressure reduction valve. Thermal degradation of the mixture is reached in the reactor device under pressure and temperature conditions equal to, or above, a value by which a supercritical condition of water is achieved, and under the turbulent flow conditions generated partly by the curved piping.

U.S. Pat. No. 6,534,689, applied for protection on 24 Aug. 2001, description defines a method of pyrolysis of waste plastics leading to fuel production. In order to separate solid particles from liquids the cyclone uses high vehicle velocity and high inert gas temperature as heat transfer carriers. This invention utilizes inert gas and hydrocarbon vapors as a heating medium.

From patent description WO 2005/065006, with priority on 23 Dec. 2003, a reactor for enrichment of recoverable oil from waste plastics is known. The invention is a reactor with FIR heater therein that coverts waste plastics into oil. The FIR heater consists of electrical resistance space, a far infrared radiator, an insulator, a protective shell, a tight set and other parts. The far infrared ray radiator can be rod-shaped, band-shaped and can be made into other shapes, and on the outside is encased by metal pipe, and painted with the far infrared radiator. So the infrared ray can directly heat the plastics, thereby turning the waste plastics into oil. This technique of splitting oil dregs and emulsification will scatter the oil dregs into atoms below 100 μm, and combine them in the emulsified oil equitably, and get 30-60° C. liquid oil in the emulsification container. Hot oil will be directly changed into burnable liquid oil and it can be stored safely at normal temperatures.

From US Patent Application Publication No US2005/0075521, applied for protection on 20 Jan. 2003, a method and plant for conversion of plastics into oil with presence of inert gas is known. The plastic raw material is dissolved in a dissolution section to form an expanded plastic and sent to an inclined first-stage decomposition column and a second-stage decomposition column. The second-stage decomposition column is adjacent to the first-stage decomposition column. Both columns have fixed temperature distributions. The plastic is depolymerized and decomposed into a light secondarily decomposed gas. The extracted secondarily decomposed gas is cooled into oil in condensers and collected in oil storage tanks.

From Polish Patent No P 380619, applied for protection on 16 Sep. 2006, the method and apparatus for catalytic depolymerization of polyolefinic waste plastics characterized by two reactors in which depolymerization takes place, one tank reactor and second flow reactor operating in cooperation is known. Shredded plastic waste is first heated, melted, and pumped under the reaction medium surface. Later plastic molten mass is dispersed in the reaction medium. The depolymerization process occurs in presence of the catalyst. From the reactor bottom reacting mixture is pumped to the flow reactor in which it is heated up to 400° C. The reaction occurs under normal and negative pressure. Pressure in the reactor depends on the planned outcome product properties. Inside flow reactor depolymerization takes place. Gas and liquid mixture comes into the tank reactor where it is split into gas and liquid fraction. Liquid phase is heated up and melts incoming plastic feedstock. In the bottom reactor area, in 360° C., the initial reaction takes place.

In the upper section, in around 400° C., the split into gas and liquids takes place. The hydrocarbon vapors produced come through the active chemically neutralizing filter and condense. Process is continuous.

From Polish Patent Application P-383709, applied for protection on 7 Nov. 2007, the apparatus and method for depolymerization of waste plastics, especially polyolefins, with removing reaction leftovers and residues is known. The apparatus consists of a feeding conveyor, a pyrolysis reactor, a and discharging section and is characterized by a gas engaging stabilizer equipped with a mixer and working in a close loop at least one external pyrolysis reactor with screw or ribbon mixer and a pipe that closes the loop. The depolymerization process is carried out with inert gas presence and characterized by reactor enforced dual flow in which one mixing direction is used as well to discharge the reaction residue.

From Polish patent application No P-386410, applied for protection on 31 Oct. 2008, an apparatus for thermolysis of waste plastics, especially polyolefins, and a method of thermolysis with continuous feeding and continuous discharging carbonizable substances and reaction leftovers is known. The apparatus includes a plastic feeding system, a pyrolysis reactor, a discharge system and according to the invention is characterized in that after the plastic feeding system is situated, the extruder and pyrolysis reactor, which height is at least 1.5 times bigger than its diameter, are connected. The pyrolysis reactor is equipped with a dual high speed propeller. The method for thermolysis of plastic waste, especially polyolefins, with presence of inert gas, according to the claims is characterized in that plastic waste is continuously fed to the extruder where it is plasticized from 180° C. up to the temperature of the reactor later, is fed to the pyrolysis reactor, where at 350-450° C. at agitator's 30-1500 rpm, the thermolysis is carried out with continuous two step fractional condensation where a light product boiling below 180° C. goes to a storage tank with a cold jacket and a heavy product boiling above 180° C. is conducted to a hot jacket tank.

SUMMARY OF THE INVENTION

The principal aim of the invention is thermolysis of waste plastics, especially polyolefins. The thermolysis method is carried out continuously with continuous removal of products and reaction residue and with simultaneous minimizing of carbonizable products formation. The invention also concerns an apparatus for conducting waste plastic thermolysis.

The apparatus for conducting waste plastic thermolysis includes a feeding system, a reactor for thermolysis, having a height at least 1.5 times bigger than its diameter, an external circulation loop, and a products collecting system characterized in that after the feeding system there is an extruder followed by a main thermolysis reactor, appointed with a dual agitator and connected with an external circulation loop involving a flux heater, a circulation pump, and a three-way valve.

Favorably, the reactor for thermolysis reactor has at least two vertical internal baffles.

Favorably, the height of the reactor for thermolysis is two times bigger than its diameter.

Favorably, the reactor for thermolysis is equipped with an independent accessory agitator.

Favorably, the agitator is a high speed mixer with different propeller blade angles.

Favorably, the agitator is a dual propeller agitator.

Favorably, the dual propeller agitator is calked by inert gas cooled by liquid.

Favorably, the shaft of the agitator is equipped with additional stabilizing bars.

Favorably, the reactor has an inspection flange in its bottom part.

Favorably, in the bottom of the reactor, there is an internal anti-whirl device.

Favorably, in the bottom of the reactor, there is an outlet piece for the reaction mixture and after the flux heater, in the upper part of reactor wall, there is inlet piece for the reaction mixture.

Favorably, over the outlet piece there is a sieve or filter.

Favorably, after the extruder squared to the reactor wall, there is an inlet piece of plasticized feedstock from the extruder and an inlet piece of feedstock from the circulation loop tangential to reactor wall.

Favorably, the inlet piece of plasticized feedstock from the extruder into the reactor is situated under the inlet piece for the reaction mixture from the circulation loop.

Favorably, the thermolysis residue collecting system comprises a three-way valve in a circulation loop, a residue cooling system, and a residue tank.

Favorably, the residue tank is cooled by current liquid.

Favorably, the reactor trigger system is equipped with a circulation pump, a bottom emergency trigger valve, and a three-way valve.

Favorably, the bottom trigger emergency valve is equipped with a drain mechanism.

Favorably, the drain mechanism is a sealed hand drain bar.

Favorably, the circulation pump follows a filter.

Favorably, the circulation pump is a vortex pump.

Favorably, the circulation pump is heated externally by an oil heating jacket.

Favorably, the circulation pump is calked by inert gas cooled by liquid.

Favorably, the flux heater is heated electrically.

The method for thermolysis of plastic waste takes place in an inert atmosphere. In the method, waste is fed continuously to the extruder and plasticized in a temperature from 180° C. up to a temperature in the reactor. The invention is characterized in that plastics are fed into the thermolysis reactor where thermolysis is carried out in a temperature from 350° C. to 450° C. with agitator 30-1500 rpm and then plasticized waste is pumped with a velocity of flow from 4 to 10 $m^3/h$ to the flux heater with heating power about 60 to 120 KW, from where a mixture of liquid and vapors, with regulated temperature of the system, is injected back to the reactor and vapors of reaction products are off taken continuously from the reactor and condensed in the following part of system. Thermolysis by-products are returned to the main thermolysis reactor and reaction leftovers are received continuously, through the heat exchanger by the three-way valve situated before the flux heater, to the residue tank.

Favorably, the thermolysis process is carried out in temperature range from 390 to 430° C.

Favorably, the thermolysis process is carried out with 200 to 700 rpm speed of the agitator.

Favorably, wastes are plasticized in the extruder in temperature range from 250 to 370° C.

Favorably, plasticized plastic is pumped with a velocity of flow 6 to 9 $m^3/h$.

Favorably, the heating power of the flux heater is 70 to 90 KW.

Advantages of the invention include the small size of the process equipment for continuous thermolysis and carrying out and giving high repeatable products with lower temperature regime without catalysts with remover heating center to external loop of reactor.

The thermolysis process is very stable due to a small temperature difference between the temperature of plasticized feedstock and thermolysis temperature. It causes a considerable decrease of energy consumption for depolymerization and lowering of feedstock residence time in the reactor affecting much lower tendency to producing coke inside both the reactor and the whole system. The external circulation loop outside the reactor is connected with the reactor by pipes and two spouts—inlet and outlet—allowing forced move of the reaction mixture in the system thermolysis reactor—circulation loop and lowering carbonization. Additionally, the reduced volume of coke is caused by using a circulation pump which causes reduction of the contact time of the reaction mixture with the hot walls of the heating system.

Using the electrical flux heater moved the heating place for the process from the thermolysis reactor and improved heating efficiency and reduced heat loss. Implementing the reactor with elongated shape and with vertical baffles enables proper mixing. More over implementing the high speed dual mixer causes more efficient mixing and equal temperature distribution inside the reactor. The inspection flange enables stripping of the reactor bottom.

An advantage of the invention is the three-way valve working in the temperature of the reactor so flux pumped from the pump is divided on stream run to heater and stream of residue maintenance-free removed. This method gives very wide hydrocarbon fraction.

BRIEF DESCRIPTION OF THE DRAWING

The FIGURE is a schematic showing the described system for thermolysis of waste plastic, especially polyolefins.

DETAILED DESCRIPTION OF THE INVENTION

The example of implementation described below does not limit possibilities of use of the invention.

System Implementation

The apparatus for conducting thermolysis of plastic waste, according to the invention, is characterized by a granulated or leaf-shaped feedstock feeding system 1 to the extruder 2. The plastic waste is plasticized in the extruder 2, heated up to 300-330° C., fed through inlet piece 17 to reactor 3 in which the thermolysis process takes place. The height of reactor 3 is two times bigger than its diameter. Reactor 3 is equipped with a dual high-speed propeller 7 with different propeller blade angles. Dual high-speed propeller 7 is calked by inert gas cooled by liquid. Reactor 3 is equipped with two internal vertical baffles on the walls 9 and 9'. The shaft of the agitator is equipped with additional stabilizing bars 11. Moreover, reactor 3 is equipped with an independent accessory agitator 10 which eliminates formation of foam. In the bottom of reactor 3 the inspection flange 12 and anti-whirl device 13 are set up. The thermolysis process of molten plastic is carried out in a temperature from 390 to 460° C. and with 200 to 700 rpm speed of the agitator. In the bottom of the thermolysis reactor 3 is a reaction mixture outlet piece 14 and a mechanical filter 16. Plasticized polymer is fed through outlet piece 14 and circulation pump 6 to external circulation loop 4 with a velocity of flow 6 to 9 $m^3$/h. A filter 22 is set up before circulation pump 6. In circulation loop 4 the reaction mixture flows through three-way valve 8 and through electrical flux heater 5, which controls process temperature. The heating power of flux heater is 70 to 90 KW. The mixture of vapors and liquid is continuously conducted through inlet piece 15 back to thermolysis reactor 3. Vapors from the process are collected in another part of the system 23 and condensed into liquid product. Thermolysis residues are collected continuously also by external circulation loop 4 in the discharge system through three-way valve 8 dividing pumped stream of reaction mixture on stream conducted to residue cooling system 18 and leftovers tank 19 and main product stream conducted through flux heater 5 and inlet piece 15 situated tangential to the reactor wall. Under the bottom of the reactor 3, a bottom emergency trigger valve 20, which is equipped with drain mechanism 21. Drain mechanism 21 is a manual or pneumatic punch. The thermolysis process is carried out in an inert gas atmosphere. The thermolysis product is a very wide hydrocarbon fraction for further rework.

What is claimed is:

1. Plastic waste thermolysis method in inert atmosphere in which waste is fed continuously to an extruder and plasticized in a temperature from 180 degrees centigrade up to a temperature in reactor, wherein plastics are fed into a thermolysis reactor where thermolysis is carried out at a temperature from 350 degrees centigrade to 450 degrees centigrade with agitator 30-1500 rpm then plasticized waste is pumped with a velocity of flow from 4 to 10 $m^3$/h to a flux heater with heating power about 60 to 120 KW, the mixture of liquid and vapors with regulated temperature of system thereafter is injected back to the reactor and vapors of reaction products are removed continuously from the reactor and condensed in the subsequent part of the system, thermolysis by-products are returned to the main thermolysis reactor and reaction leftovers are received continuously through heat exchanger by three-way valve situated before flux heater to residue tank.

2. The method according to claim 1 wherein the thermolysis process being at least one of:

carried out in temperature range 390 to 430 degrees centigrade;

carried out with 200 to 700 rpm of agitator;

plasticizing the wastes in the extruder in a temperature range of 250 to 370 degrees centigrade;

wherein the plasticized plastic is pumped with velocity of flow 6 to 9 $m^3$/h. and wherein the heating power of flux heater is 70 to 90 KVV.

* * * * *